US007565824B1

(12) United States Patent
Gleason

(10) Patent No.: US 7,565,824 B1
(45) Date of Patent: Jul. 28, 2009

(54) LCD MONITOR SECURITY TIE-DOWN APPARATUS

(76) Inventor: Neil V. Gleason, 22672 Mandarina La., Trabuco Canyon, CA (US) 92679

( * ) Notice: Subject to any disclaimer, the term of this patent is extended or adjusted under 35 U.S.C. 154(b) by 0 days.

(21) Appl. No.: 12/288,396

(22) Filed: Oct. 21, 2008

(51) Int. Cl.
*E05B 73/00* (2006.01)

(52) U.S. Cl. ..... 70/58; 70/232; 70/DIG. 57; 248/552; 248/553

(58) Field of Classification Search ..... 70/58, 70/232, DIG. 57, 14, 18, 30, 49, 57, 229–231; 248/551–553; 361/679.57
See application file for complete search history.

(56) References Cited

U.S. PATENT DOCUMENTS

| | | | | | |
|---|---|---|---|---|---|
| 2,500,375 | A | * | 3/1950 | Parker | 70/232 |
| 3,434,312 | A | * | 3/1969 | Buchman | 70/58 |
| 3,625,031 | A | * | 12/1971 | Alley | 70/58 |
| 3,765,197 | A | * | 10/1973 | Foote | 70/58 |
| 3,817,065 | A | * | 6/1974 | Sander | 70/232 |
| 3,859,826 | A | * | 1/1975 | Singer et al. | 70/58 |
| 4,065,946 | A | * | 1/1978 | Loynes et al. | 70/58 |
| 4,157,602 | A | * | 6/1979 | Pennell | 24/370 |
| 4,212,175 | A | * | 7/1980 | Zakow | 70/58 |
| 4,228,983 | A | * | 10/1980 | Bowman, Jr. | 248/553 |
| 4,361,305 | A | | 11/1982 | Gassaway | |
| 4,444,031 | A | * | 4/1984 | Watson | 70/232 |
| 4,448,049 | A | | 5/1984 | Murray | |
| 4,579,311 | A | | 4/1986 | Spranza, III | |
| 4,584,856 | A | * | 4/1986 | Petersdorff et al. | 70/57 |
| 4,658,607 | A | * | 4/1987 | Muse et al. | 70/164 |
| 4,733,840 | A | | 3/1988 | D'Amore | |
| 5,220,815 | A | * | 6/1993 | Davidge et al. | 70/14 |
| 5,351,507 | A | * | 10/1994 | Derman | 70/18 |
| 5,406,809 | A | * | 4/1995 | Igelmund | 70/2 |
| 5,660,451 | A | | 8/1997 | Glynn | |
| 5,794,463 | A | * | 8/1998 | McDaid | 70/18 |
| 5,904,056 | A | * | 5/1999 | Ozaki | 70/18 |
| 6,192,719 | B1 | * | 2/2001 | Stukas et al. | 70/18 |
| 2004/0035157 | A1 | * | 2/2004 | Petrick et al. | 70/58 |

* cited by examiner

*Primary Examiner*—Lloyd A Gall
(74) *Attorney, Agent, or Firm*—Gordon K. Anderson

(57) ABSTRACT

A security tie-down apparatus is taught which is used in conjunction with a LCD monitor of the type incorporating a flat display mounting interface configured in accordance with Video Electronics Standards Association (VESA) mounting interface standards. The apparatus attaches a mounting plate to the LCD monitor utilizing the VESA mounting interface standard threaded holes, using flat head screws. A mounting plate cover encloses the mounting plate that engages the LCD monitor rear surface and a cable retaining adapter engages the mounting plate cover in such a manner as to obscure the contact union therebetween. An adapter shoulder bolt is disposed within the adapter and attaches to the mounting plate and also engages the mounting plate cover with the adapter. A security cable runs completely through the adapter obscuring the adapter shoulder bolt, and when the cable is anchored onto a fixed surface, the LCD monitor is protected from unauthorized removal or theft.

16 Claims, 2 Drawing Sheets

LCD MONITOR SECURITY TIE-DOWN APPARATUS

TECHNICAL FIELD

The present invention relates to electronic equipment security devices in general. More specifically to a tie-down apparatus for a LCD Monitor which includes mounting bracket, cover and cable for attachment to a secure surface.

BACKGROUND OF THE INVENTION

Previously, many types of security devices have been used in endeavoring to provide an effective means to protect electronic equipment from unauthorized removal and theft.

The prior art listed below did not disclose patents that possess any of the novelty of the instant invention; however the following U.S. patents are considered related:

| Pat. No. | Inventor | Issue Date |
|---|---|---|
| 4,361,305 | Gassaway | Nov. 30, 1982 |
| 4,448,049 | Murray | May 15, 1984 |
| 4,579,311 | Spranza III | Apr. 1, 1986 |
| 4,733,840 | D'Amore | Mar. 29, 1988 |
| 5,660,451 | Glynn | Aug. 26, 1997 |

Gassaway in U.S. Pat. No. 4,361,305 teaches a security device for rotatably mounting an article to a surface. The device includes a base with a face, a center and a peripheral rail having a downwardly facing bearing surface. The invention is mountable to a surface by adhesive spacing the base from the surface. A clasp in two parts slide together providing bearing surfaces to hold the clasp rotatably to the base. U.S. Pat. No. 4,448,049 issued to Murray provides a security tie-down apparatus that includes an anchor bolt with a base plate secured thereto in axially spaced relation from the bolt head. A disc is rotatably carried on the anchor bolt between the base plate and head and surrounds the head so as to prevent grasping of the head by tools. Additional hold down bolts may be provided for securing the base plate to the object and offset access holes through the disk enabling passage of the hold-down screws therethrough.

Spranza III in U.S. Pat. No. 4,579,311 discloses an equipment lockdown apparatus for locking pieces of equipment such as computer modules, typewriters and the like. A sub-base is secured to a desk or a supporting structure which supports the remainder of the unit for rotation. A base shelf is included together with a pedestal which rotatably supports one of more additional shelves. Shields are positioned adjacent to each shelf to preclude access to the fastening elements.

D'Amore in U.S. Pat. No. 4,733,840 teaches a security system for preventing theft of items such as typewriters and personal computers. The system has a security plate which is fixed to the item to be secured. A bendable member is permanently attached to a center area of the plate base and has a free end spaced on the center area of the base. A loop is formed on the free end for attaching the bendable member to a cable chain, or the like, used to attach the plate to the anchor. When an attempt is made to forcibly remove the item, the bendable member bends to direct the removal force to the center of the plate where it can be distributed over the entire base thereby more effectively resisting the force.

U.S. Pat. No. 5,660,451 issued to Glynn is for a computer component securing device having a main housing with a storage portion, a pair of table securing portions, positioning means, locking means and table securing means. The positioning means position the computer component so as to have an open position for removal and closed position and are attached to the main housing. The locking means are connected to both the positioning means and the main housing permitting locking and unlocking when in the open and closed position. The table securing means extend through at least one opening in the securing portion.

BRIEF SUMMARY OF THE INVENTION

Total security to prevent theft of a portable object related to electronic equipment may not be possible, however devices and systems may be used which would delay or otherwise inhibit the swift and easy removal of the object. There is no absolute system that would allow the portable object to be secured short of being locked in a safe although even the most elaborate safe may be violated in some manner, as has been accomplished in the past. When it comes to portable electronic equipment that may be part of a system, such as a LCD monitor for use with a computer, the most reasonable method of protection would be a simple and straightforward tie-down that could be attached to a post, a wall, a floor, through a hole in a rigid structure, a table leg by surrounding and securing with a lock or simply fastening to an anchor that is well known in the art and readily available.

It is therefore the primary object of the invention to provide an uncomplicated and inexpensive apparatus to protect a specific electronic component that is part of a computer system that provides the necessary visual display. In today's technology industry standards for video electronics has been created, known as VESA (Video Electronics Standards Association), to standardize on certain items that may be used universally in the industry. The LCD (liquid crystal display) monitor is one of the components that may use the standard for mounting the monitor on a wall with a bracket or some other means requiring attachment.

The novelty and uniqueness of the present invention is that the mounting pattern and threaded screw holes in the back of the monitor, meeting the VESA standards, are present in most LCD monitors may be used for a security tie-down without the need for any modification to the structure. A plain steel bar mounting plate with the appropriate countersunk holes is attached directly to the back of the monitor and a cover plate encloses the plate covering the appropriate mounting screws. An adapter is also attached to the plate though the cover which provides an interface with a security cable and also acts as a protective cover over a shoulder bolt that is used to attach the adapter to the plate. The security cable may then be attached to a secure object in the conventional manner well known in the art.

An important object of the invention is the ease of position adjustment of the monitor on a desk or table as the cable is flexible enough to allow movement and relocation without disconnecting the any portion of the cable. Many security systems require fixed locations with attachment plates, and the like, underneath the item which do not permit movement in any direction.

Another object of the invention is in the fact that if the mounting plate was in some way pried loose from its connection to the case of the monitor, the thief would realize that selling or "fencing" would be limited as the monitor would visually show the damage to its back surface making the item un-saleable on the open market.

Still another object of the invention is that the apparatus is simple and straightforward enough to be cost effective and easy to manufacturer making the invention within the reach of the masses.

Yet another object of the invention is that the use of a security cable is visual indication that the monitor is protected and not particularly easy to remove or steal without the use of specialized theft tools.

A further object of the invention is the ability of the security cable to be rotated in relation to the mounting plate cover as the cable retaining adapter swivels on a shoulder bolt. This ability to direct the cable in any axial rotation is extremely important permitting the cable to be directed in a 360 degree orientation permitting the most optimum position of the cable thereby eliminating kinking and providing the most direct route to anchor the second end of the cable.

A final object of the invention is that installing the system to the monitor requires only conventional screwdrivers which are normally found in households and commercial facilities.

These and other objects and advantages of the present invention will become apparent from the subsequent detailed description of the preferred embodiment and the appended claims taken in conjunction with the accompanying drawings.

DETAILED DESCRIPTION OF THE INVENTION

The best mode for carrying out the invention is presented in terms of a preferred embodiment of a LCD monitor security tie-down apparatus 10 which is configured for attachment to LCD monitor having a flat display mounting interface in accordance with Video Electronics Standards Association (VESA) mounting interface standards.

Figure 1:
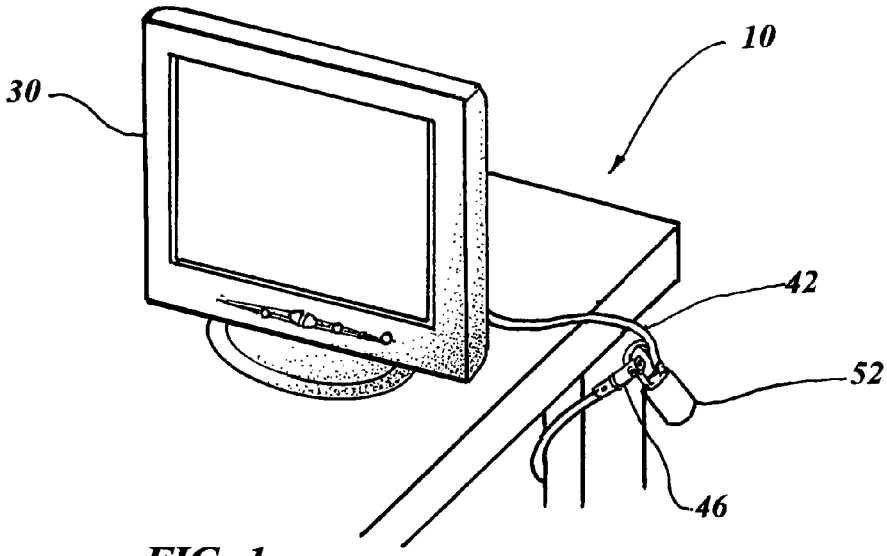
FIG. 1 is a partial isometric view of the LCD monitor security tie-down apparatus in the preferred embodiment installed onto the monitor sitting on a desk with the cable secured around the desk structure.

This preferred embodiment is shown in FIGS. 1 thorough 16 and is comprised of a mounting plate 20 configured to mate with a bolt pattern on a rear surface of the LCD monitor meeting the VESA mounting interface standards. The bolt pattern consists of four screw holes having an M4 thread 10 mm deep arranged in a square with the horizontal and vertical distance between the screw centers being either 75 mm or 100 mm. In many cases the so called 75 mm or MIS-D75 and the 100 mm MIS-D 100 are combined permitting both patterns to be employed on the same monitor.

The mounting plate 20 consists of a bar preferably made of number 4 gauge nominal (0.204) inch thick cold rolled steel having a black oxide finish and essentially ⅝ inches wide and long enough to contain four countersunk screw holes with two first holes 22 arranged 75 mm apart and two second holes 24 arranged 100 mm apart and one centrally located ¼-20 threaded hole 26. The mounting plate countersunk holes 22 and 24 are sized to permit a flat head screw to have the head flush with an outside surface of the mounting plate.

At least two mounting plate screws 28 attach the mounting plate 20 to an LCD monitor 30 with each mounting plate screw 28 preferably consisting of a flat head steel machine screw with an M4 thread, 10 mm long with a black oxide finish.

Figure 2:
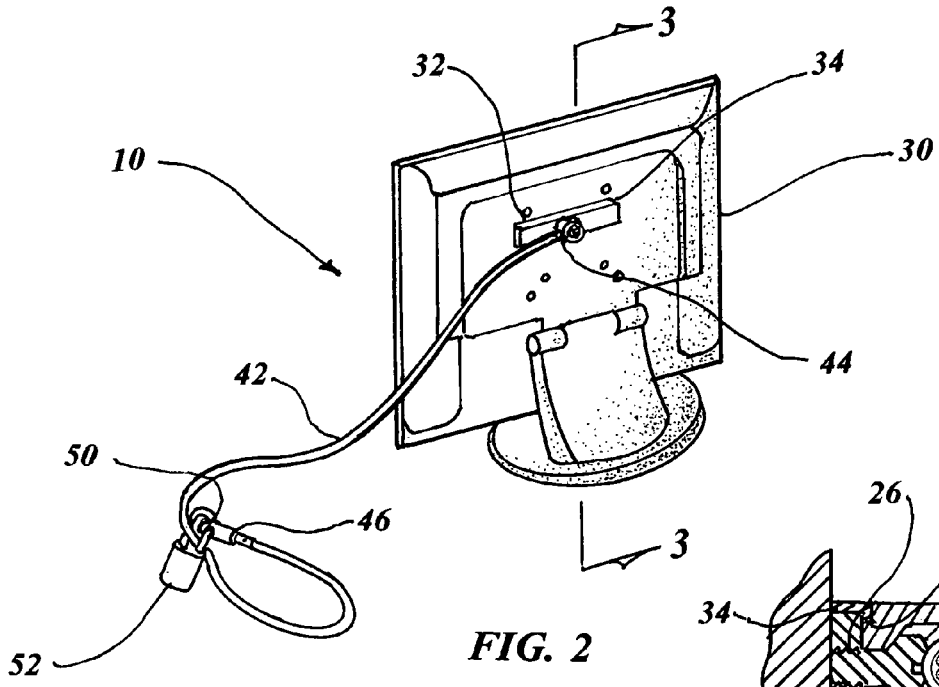
FIG. 2 is a rear view of the LCD monitor security tie-down apparatus in the preferred embodiment attached to a monitor.
Figure 3:
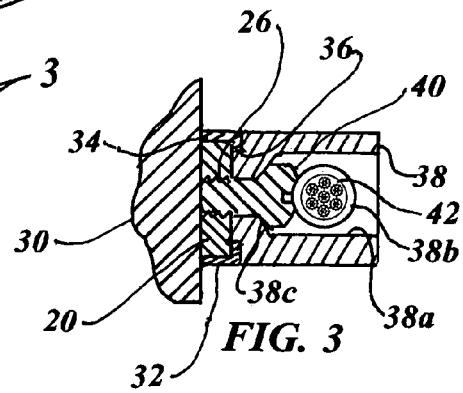
FIG. 3 is a cross sectional view taken along lines 3-3 of FIG. 2 illustrating the LCD monitor security tie-down apparatus without the monitor illustrated.
Figure 4:
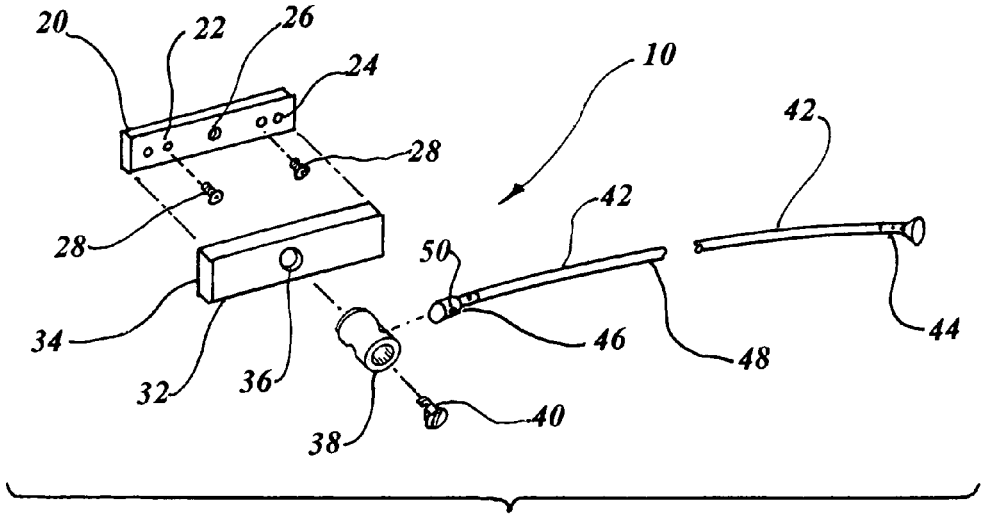
FIG. 4 is an exploded isometric view of the LCD monitor security tie-down apparatus in the preferred embodiment.
Figure 5:
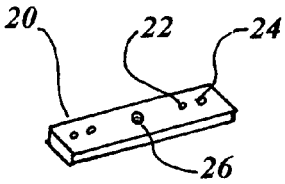
FIG. 5 is a partial isometric view of the monitor mounting plate completely removed from the invention for clarity.
Figure 6:
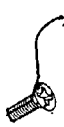
FIG. 6 is a partial isometric view of one of the mounting plate screws completely removed from the invention for clarity.
Figure 7:
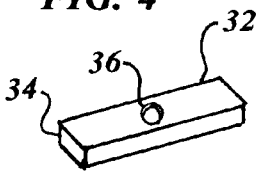
FIG. 7 is a partial isometric front view of the mounting plate cover completely removed from the invention for clarity.
Figure 8:
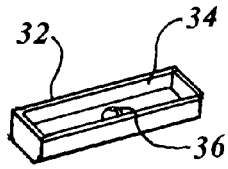
FIG. 8 is a partial isometric rear view of the mounting plate cover completely removed from the invention for clarity.
Figure 9:
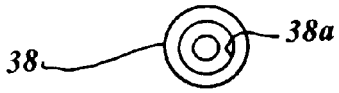
FIG. 9 is a top view of the cable retaining and mounting plate adapter completely removed from the invention for clarity.
Figure 10:
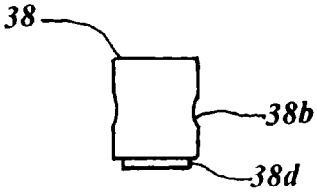
FIG. 10 is a left side view of the cable retaining and mounting plate adapter completely removed from the invention for clarity, with the right side view in mirror image thereof.
Figure 11:
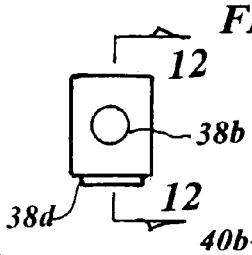
FIG. 11 is a front view of the cable retaining and mounting plate adapter completely removed from the invention for clarity.
Figure 12:
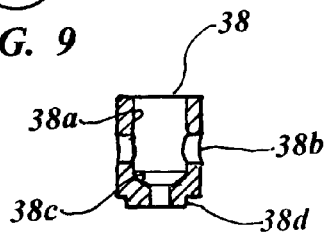
FIG. 12 is a cross sectional view taken along lines 12-12 of FIG. 11.
Figure 13:
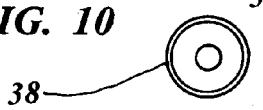
FIG. 13 is a bottom view of the cable retaining and mounting plate adapter completely removed from the invention for clarity.
Figure 14:
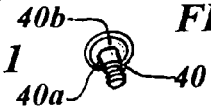
FIG. 14 is a partial isometric top view of the adapter shoulder bolt completely removed from the invention for clarity.
Figure 15:
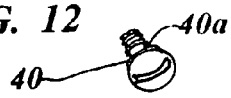
FIG. 15 is a partial isometric bottom view of the adapter shoulder bolt completely removed from the invention for clarity.

A mounting plate cover 32 is configured to completely enclose the mounting plate 20 along with the mounting plate screws 28 and contiguously engages the LCD monitor 30 on a rear surface, as illustrated in FIGS. 2 and 3. The mounting plate cover 32 preferably has a rectangular configuration with an inwardly facing peripheral flange 34, as depicted in FIGS. 7 and 8. The preferred material for the mounting plate cover 32 is number 16 gauge nominal (0.0598) inch thick cold rolled steel with a black oxide finish. The mounting plate cover 32 preferably includes a centrally located adapter receiving hole 36 having a diameter of not more than 0.56 inch.

A cable retaining adapter 38 includes an inside bore **38*a* and a thru-hole 38*b*. The adapter 38 engages the mounting plate cover 32 obscuring the contact between the adapter and the mounting plate, as illustrated in FIG. 3, to eliminate the possibility of prying the cover off from the outside. The cable retaining adapter 38 preferably has an outside diameter of from 0.60 inch to 0.70 inch with a length of from 0.70 inch to 0.80 inch long, a bore 38*a* having an inside diameter of from 0.40 to 0.44, the thru-hole 38*b* having a diameter of from 0.26 inch to 0.30 inch and an extended register 38*d* having an outside diameter of from 0.53 inch to 0.55 inch diameter and a depth of no more than 0.60 inch. FIGS. 9 through 13 illustrate the adapter 38 removed from the tie-down apparatus components with the adapter 38** best fabricated of steel with black oxide finish.

In order to attach the adapter 38 to both the mounting plate 20 and mounting plate cover 32 an adapter shoulder bolt 40 is utilized. This shoulder bolt 40 preferably has an internal countersunk pan head, which threadably screws into the ¼-20 threaded hole 26 in the mounting plate 20 with the shoulder 40*a* of the bolt 40 engaging the plate outward surface and the internal countersink of the pan head shoulder bolt 40 engaging a tapered shoulder 38*c* within the inside diameter of the adapter 38.

Figure 16:
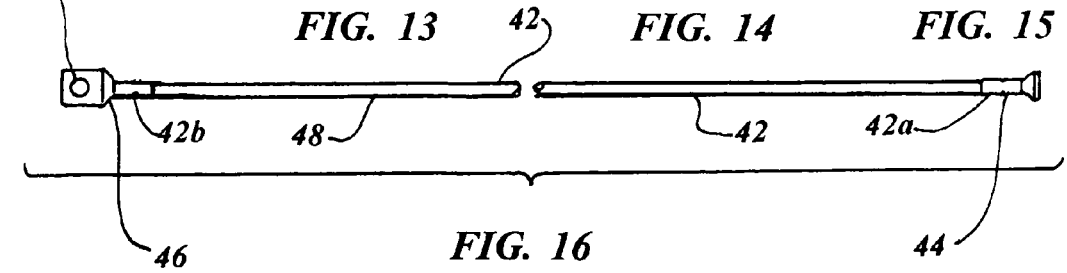
FIG. 16 is a fragmentary front elevation view of the security cable completely removed from the invention for clarity.

A thermoplastic coated security cable 42, having a obstruction means on a first end 44 and attachment means on a second end 46, with the cable 42 disposed through the adapter thru-hole 38*b* obscuring the pan head of the adapter shoulder bolt 40 with the first end 44 of the cable obstruction means. The cable 42 preferably has a ¼ inch nominal diameter and a length of at least 36 inches and is best constructed of 7×19 strand aircraft cable. A flat head compression sleeve adapter 42*a* is attached on said first end 44 of the cable 42 and a cylindrical compression sleeve adapter 42*b* with ¼ inch nominal thru-hole 50 on the cable second end 46, as illustrated in FIG. 16. The thermoplastic coating 48 may be vinyl, nylon, or any other suitable material.

When the cable second end 46 is anchored to a fixed surface the LCD monitor 30 is protected from unauthorized removal or theft. The fixed surface may be any type or arrangement with FIGS. 1 and 2 illustrating a simple loop around a table leg with the cable 42 looped through the hasp of a padlock 52 and the hasp entering the ¼ inch thru-hole 50 in the second end 46. There are a myriad of other types of anchors that are acceptable for use with the invention such as a scissor clip, a glue on fastener, a disc fastener, an epoxy disc, a cable trap, a two hole bracket, expansion plates, a tension tie-down, holes in the desk or table top with a padlock underneath etc.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A security tie-down apparatus for a LCD monitor which comprises, a LCD monitor incorporating a flat display having a mounting interface, a mounting plate attached to the LCD monitor at the mounting interface, a mounting plate cover enclosing the mounting plate engaging the LCD monitor rear surface, a cable retaining adapter engaging the mounting plate cover in such a manner as to permit obscuring contact directly to the mounting plate attached to the LCD monitor, an adapter shoulder bolt, disposed within the cable retaining adapter, attaching to the mounting plate as well as engaging the adapter to the mounting plate cover, and a security cable is disposed through the adapter obscuring the adapter shoulder bolt, and when the cable is anchored onto a fixed surface, the LCD monitor is protected from unauthorized removal or theft.

2. A security tie-down apparatus for a LCD monitor which comprises, a LCD monitor incorporating a flat display having a mounting interface, a mounting plate configured to mate with a bolt pattern on a rear surface of the LCD monitor, a plurality of mounting plate screws attaching the mounting plate to the LCD monitor, a mounting plate cover completely enclosing the mounting plate along with the mounting plate screws and contiguously engaging the LCD monitor rear surface, a cable retaining adapter having an inside bore and a thru-hole therein with the adapter engaging the mounting plate cover in such a manner as to permit securing contact directly to the mounting plate engaging the LCD monitor, an adapter shoulder bolt, having a pan head, disposed within the cable retaining adapter, attaching the mounting plate to the adapter with a shoulder of the bolt engaging the mounting plate outward surface and the pan head engaging a tapered shoulder formed within the adapter, and a thermoplastic coated security cable having a obstruction means on a first end and attachment means on a second end with the cable disposed within the adapter thru-hole obscuring the pan head of the adapter shoulder bolt with the first end of the cable obstruction means, when the cable second end is anchored to a fixed surface the LCD monitor is protected from unauthorized removal or theft.

3. The security tie-down apparatus for a LCD monitor as recited in claim 2 wherein said mounting plate further comprises four countersunk screw holes with two arranged 75 mm apart and two arranged 100 mm apart with one centrally located ¼-20 thread size threaded hole.

4. The security tie-down apparatus for a LCD monitor as recited in claim 2 further comprising said mounting plate having countersunk holes sized to permit a flat head screw to have the head flush with an outside surface of the mounting plate.

5. The security tie-down apparatus for a LCD monitor as recited in claim 2 wherein said mounting plate further comprises a material 4 gauge nominal (0.204) inch thick cold rolled steel having a black oxide finish.

6. The security tie-down apparatus for a LCD monitor as recited in claim 2 wherein each mounting plate screw further comprises a flat head steel machine screw M4 metric pitch diameter thread, 10 mm long with a black oxide finish.

7. The security tie-down apparatus for a LCD monitor as recited in claim 2 wherein said mounting plate cover having a rectangular configuration with an inwardly facing peripheral flange.

8. The security tie-down apparatus for a LCD monitor as recited in claim 2 wherein said mounting plate cover further comprises a material 16 gauge nominal (0.0598) inch thick cold rolled steel having a black oxide finish.

9. The security tie-down apparatus for a LCD monitor as recited in claim 2 wherein said mounting plate cover having a centrally located adapter receiving hole.

10. The security tie-down apparatus for a LCD monitor as recited in claim 9 wherein an adapter receiving hole of said mounting plate cover having a diameter of not more than 0.56 inch.

11. The security tie-down apparatus for a LCD monitor as recited in claim 2 wherein said cable retaining adapter having an outside diameter of from 0.60 inch to 0.70 inch with a length of from 0.70 inch to 0.80 inch long, the bore inside diameter of from 0.40 inch to 0.44 inch the thru-hole having a diameter of from 0.26 inch to 0.30 inch and an extended register having an outside diameter of from 0.53 inch to 0.55 inch diameter and a depth of no more than 0.60 inch.

12. The security tie-down apparatus for a LCD monitor as recited in claim 2 wherein said cable retaining adapter fabricated of steel with black oxide finish.

13. The security tie-down apparatus for a LCD monitor as recited in claim 2 wherein said adapter shoulder bolt fabricated of plated steel with the bolt having a male ¼-20 thread size.

14. The security tie-down apparatus for a LCD monitor as recited in claim 2 wherein said security cable having a ¼ inch nominal diameter and a length of at least 36 inches constructed of 7×19 strand aircraft cable.

15. The security tie-down apparatus for a LCD monitor as recited in claim 2 wherein said security cable having a compression sleeve adapter, with a flat head on said first end and a cylindrical compression sleeve adapter with ¼ inch nominal thru-hole on the second end.

16. The security tie-down apparatus for a LCD monitor as recited in claim 2 wherein said security cable thermoplastic coating is selected from the group consisting of vinyl and nylon.

* * * * *